US012796842B2

(12) United States Patent
Schwartz

(10) Patent No.: US 12,796,842 B2
(45) Date of Patent: Nov. 17, 2026

(54) MEMORABILIA DISPLAY DEVICE

(71) Applicant: Bracha Partners LLC, Clifton, NJ (US)

(72) Inventor: David Schwartz, Brooklyn, NY (US)

(73) Assignee: Bracha Partners LLC, Clifton, NJ (US)

( * ) Notice: Subject to any disclaimer, the term of this patent is extended or adjusted under 35 U.S.C. 154(b) by 0 days.

(21) Appl. No.: 18/776,208

(22) Filed: Jul. 17, 2024

(65) Prior Publication Data

US 2025/0151931 A1 May 15, 2025

Related U.S. Application Data

(60) Provisional application No. 63/527,318, filed on Jul. 17, 2023.

(51) Int. Cl.
*A47G 1/06* (2006.01)

(52) U.S. Cl.
CPC ..... *A47G 1/065* (2013.01); *A47G 1/0616* (2013.01)

(58) Field of Classification Search
CPC ..... A47G 1/065; A47G 1/0616; A47G 1/12
USPC ..... D6/301
See application file for complete search history.

(56) References Cited

U.S. PATENT DOCUMENTS 5,096,752 A * 3/1992 Wagner ..... G09F 3/20 40/776
5,105,567 A * 4/1992 Real ..... G09F 7/10 40/776
5,109,977 A * 5/1992 Mayer ..... A47G 1/12 206/508
5,956,877 A * 9/1999 Raasch ..... G03B 21/64 40/124.11
6,119,386 A * 9/2000 Henry ..... A47G 1/065 40/772
8,595,969 B1 * 12/2013 Wheelis ..... A47G 1/12 206/778
2003/0033745 A1 * 2/2003 Ribaudo ..... A47G 1/12 40/800
2005/0160651 A1 * 7/2005 Davis ..... A47G 1/065 40/700
2006/0248769 A1 * 11/2006 Rose ..... G09F 1/12 40/734
2007/0234621 A1 * 10/2007 McCorkle ..... A47G 1/065 40/773
2010/0050491 A1 * 3/2010 Grange ..... A47G 1/065 40/735
2010/0251585 A1 * 10/2010 Schaefer ..... A47G 1/065 40/735
2013/0125437 A1 * 5/2013 Tiede ..... E06B 3/5892 40/725
2016/0133080 A1 * 5/2016 Johnson ..... G07D 9/002 705/26.8
2022/0254280 A1 * 8/2022 Chiu ..... G09F 3/18
(Continued)

*Primary Examiner* — Gary C Hoge
(74) *Attorney, Agent, or Firm* — Tarter Krinsky & Drogin LLP

(57) ABSTRACT

A display system for displaying cards or similar memorabilia. The system includes a front transparent panel that cooperates with a backing panel having one or more card slots receive and display one or more cards. The one or more card slots a provided adjacent to a printed image on the front panel. The cards are displayed in connection with a main thematic image thereby creating a pleasing display allowing for the display of a collection of cards.

3 Claims, 9 Drawing Sheets

(56) References Cited

U.S. PATENT DOCUMENTS

| | | | | |
|---|---|---|---|---|
| 2023/0084781 | A1* | 3/2023 | Schwartz | G02B 30/26<br>40/427 |
| 2023/0218979 | A1* | 7/2023 | Lee | A63F 1/062<br>273/148 A |

* cited by examiner

MEMORABILIA DISPLAY DEVICE

RELATED APPLICATIONS

This application claims the benefit of pending Prov. Appl. 63/527,318 filed on Jul. 17, 2023, the contents of which are incorporated by reference herein.

FIELD OF THE INVENTION

The present disclosure relates to the field of memorabilia displays, more specifically to a panel configured for display of one or more baseball cards or similar memorabilia items.

BACKGROUND OF THE INVENTION

Sports cards are a popular collector's item that are bought, traded and maintained by people across the country and across the world.

SUMMARY OF THE INVENITON

Embodiments of the invention provide a display panel that is configured to display one or more baseball cards. The display panel includes a printed graphic of a sports scene and a retaining region configured to receive and store a baseball card or similar item. In embodiments of the invention, the card is entirely encapsulated within the display. In other embodiments of the invention, the card is only partially encapsulated so that either the front, back, or both sides of the card are accessible to observers.

In embodiments of the invention the printed graphic includes a series of lenses to provide configured to enlarge underlying repeating images, which provides the appearance of dimensionality. This makes the display more interesting and aesthetically pleasing.

BRIEF DESCRIPTION OF THE DRAWINGS

The foregoing and other objects of the present disclosure will be apparent upon consideration of the following detailed description, taken in conjunction with the accompanying drawings, and claims, in which like reference characters refer to like parts throughout, and in which:

DETAILED DESCRIPTION OF THE INVENTION

Exemplary embodiments of the various methods and apparatuses will now be described with reference to the figures. The following description of the various embodiments is merely exemplary in nature and is in no way intended to limit the scope of the disclosure, its application, or uses. It will be understood that various modifications of the present disclosure are possible without departing from the spirit of the disclosure. Also, features or steps described herein may be omitted, additional steps or features may be included, and/or features or steps described herein may be combined in a manner different from the specific combinations recited herein without departing from the spirit of the disclosure, all as understood by those of skill in the art.

Figure 1:
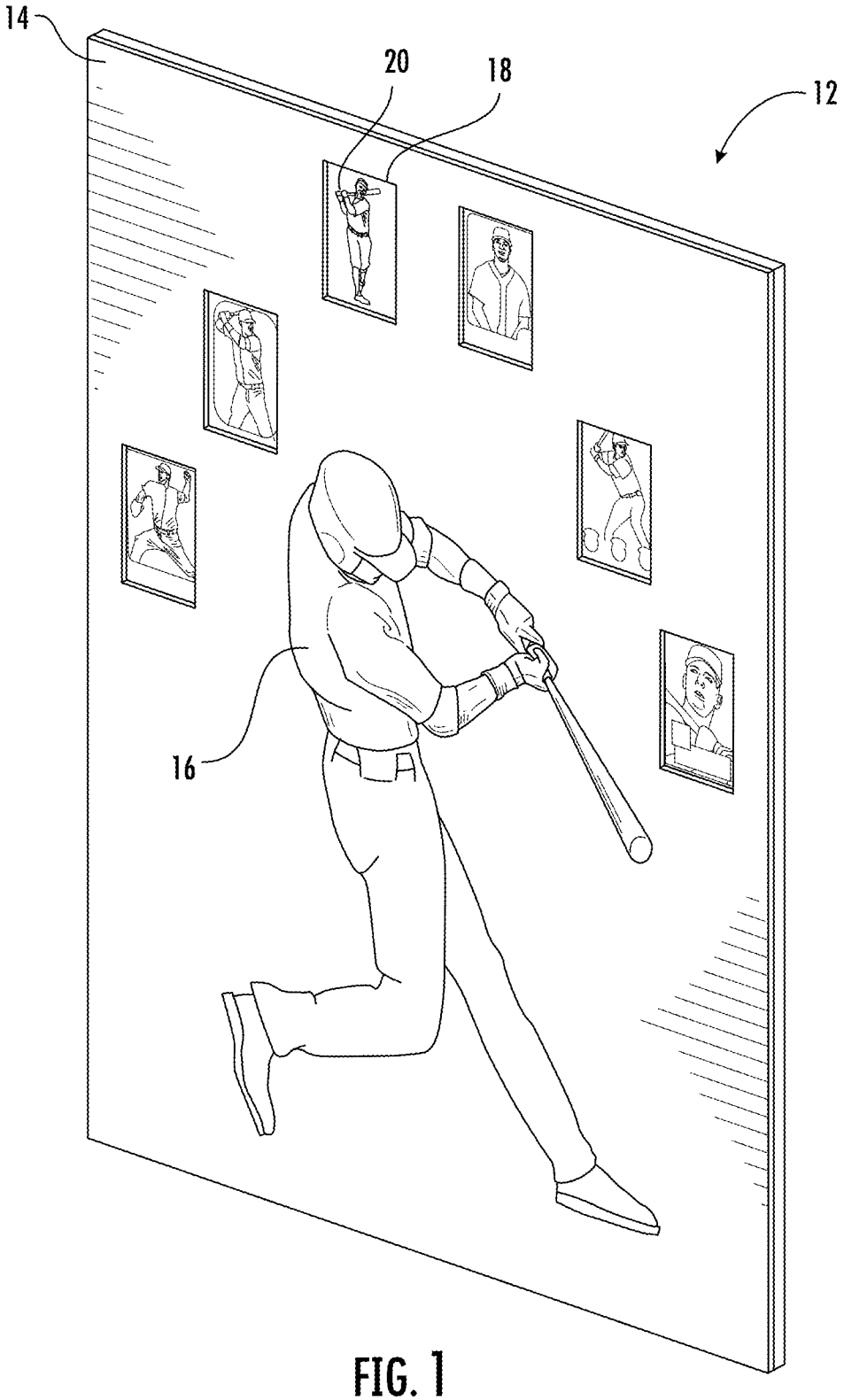
FIG. 1 is a perspective front view of a display panel having front openings in accordance with an embodiment of the invention.
Figure 2:
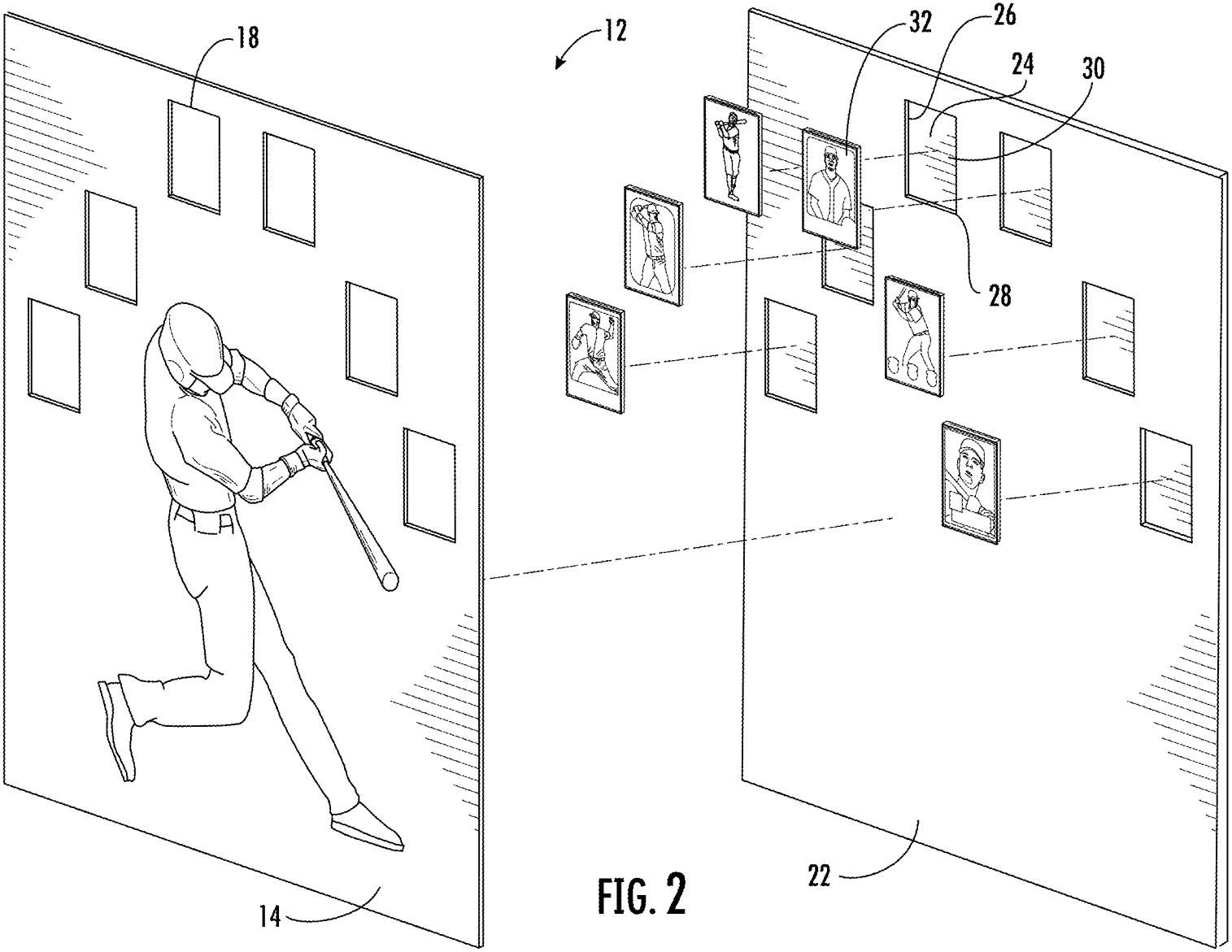
FIG. 2 is an exploded view of the display panel of FIG. 1 in accordance with an embodiment of the invention.

FIG. 1 shows a display panel 12 in accordance with an embodiment of the invention. As shown, an outer panel 14 contains a printed graphic (e.g. featured image 16) and one or more cutouts (e.g. 18) configured as windows to display one more underlying cards 20. FIG. 2 shows an exploded view of display panel 12. As shown, outer panel 14 is provided with a cutout 18 that is sized and shaped to be incrementally smaller than the outside perimeter of a card 20 or similar item.

With continued reference to FIG. 2, backing panel 22 is also shown having one or more pockets 24. Pockets 24 are indentations or impressions made to the material of backing panel 22. In embodiments of the invention, backing panel 22 is made of foam or similar material and pockets 24 are compressed or carved areas. Pockets 24 are substantially sized and shaped to retain a card 32. As shown, pockets (e.g. 24) are a stepped down region of backing panel 22 having a two parallel vertical retaining surfaces (e.g. 26) and two parallel horizontal retaining surfaces (e.g. 28) and a floor surface 30.

A user inserts a card (e.g. 32) into a pocket (e.g. 24) with the back of the card resting on floor surface 30. Respective vertical and horizontal retaining surfaces maintain the card 32 in place. Thereafter, the outer panel 14 is aligned with backing panel 22 such that one or more openings (e.g. 18) align with corresponding pockets (e.g. 24).

Figure 3:
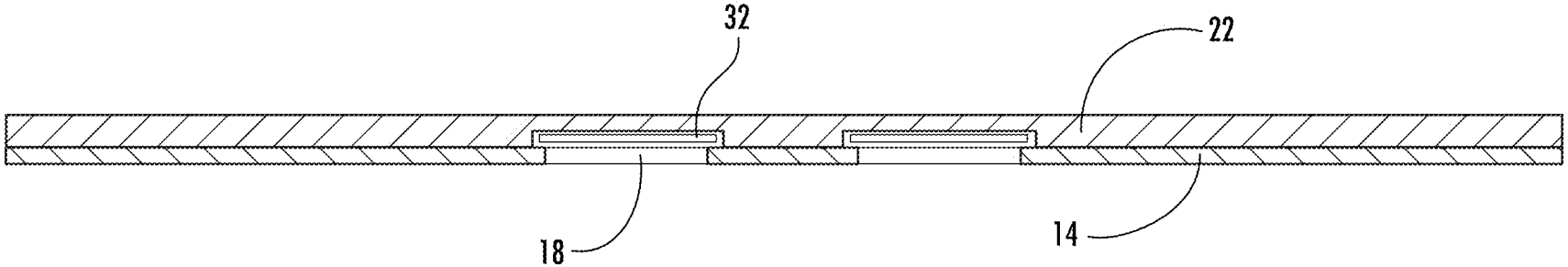
FIG. 3 is a top cross-sectional view of display panel of FIGS. 1 and 2 in accordance with an embodiment of the invention.
Figure 3A:
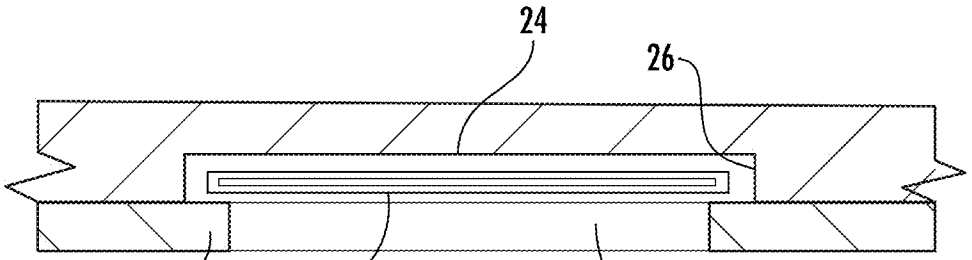
FIG. 3A is an enlarged view of a card secured in a pocket in accordance with an embodiment of the invention.

In embodiments of the invention, and as best shown in FIG. 3, cutout 18 is not in exact registry with the contours of pocket 24—rather, cutout 18 is incrementally smaller in width and height than the dimensions of pocket 24. As such, there are regions of cutout 18 that extend in the direction toward the center of pocket 24 past the vertical and horizontal retaining surface 26, 28. For example, as best shown in FIG. 3A, overhanging area 34 of cutout 18 extends past a first vertical retaining surface of pocket 24. A similar second overhanging area extends past a second vertical retaining surface (e.g. 26) of pocket 24. Overhanging area 34 (and opposing overhanging area) contacts the front peripheral vertical area of card 32 and forms a physical barrier preventing card 32 from moving. Upper and lower horizontal overhanging areas extend past horizontal retaining surfaces. In this regard, vertical and horizontal overhanging areas of cutout 18 contact the front surface of card 32 and the floor surface 30 of pocket 24 contacts the rear surface of a card—the card, thus, being sandwiched and maintained between the cutout overhanding areas and the pocket floor.

Sides and the top and bottom of card 32 are retained in place by vertical and horizontal retaining surfaces 26, 28.

Figure 4:
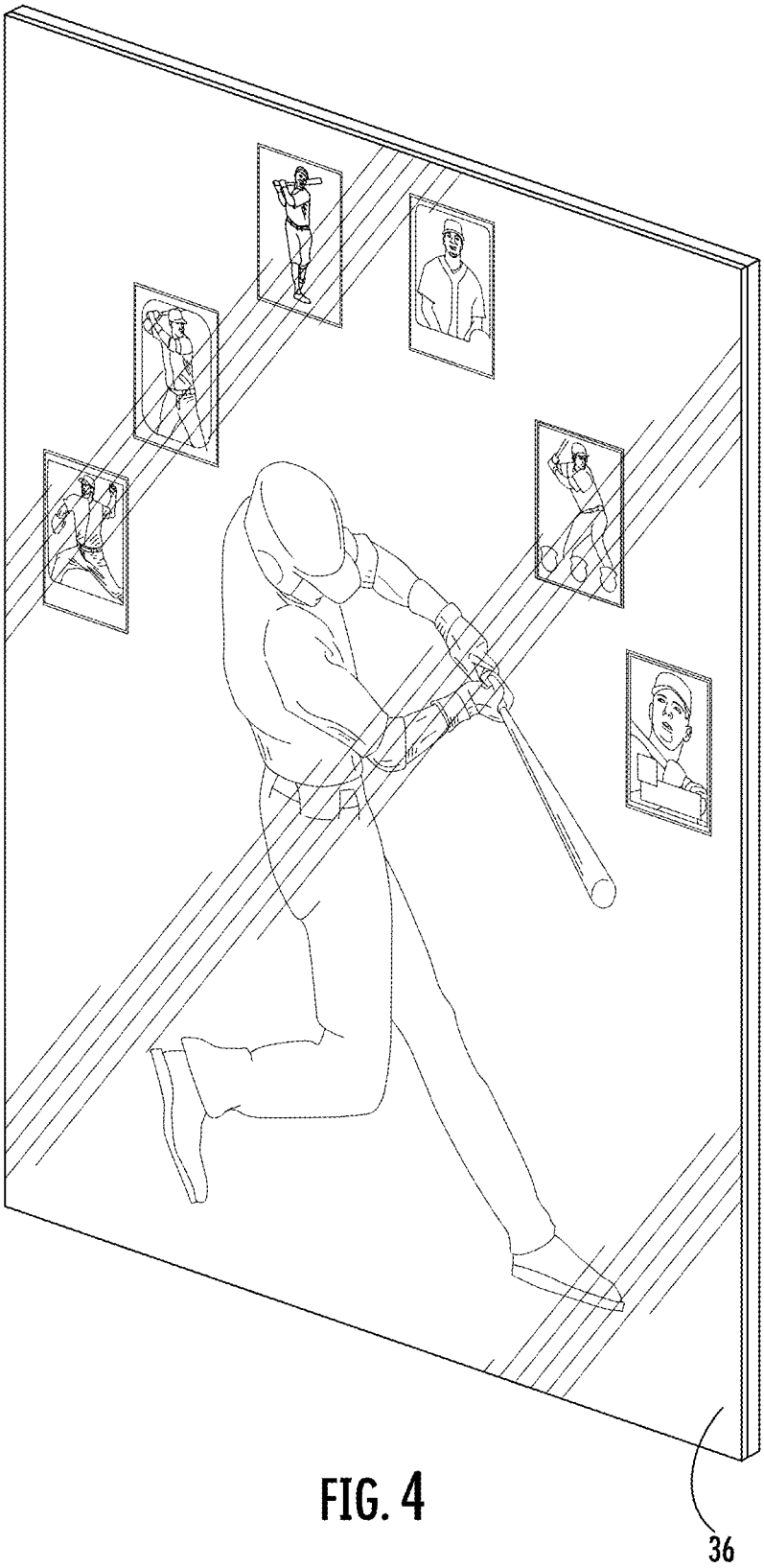
FIG. 4 is a perspective front view of a display panel for fully encapsulating a card in accordance with an embodiment of the invention.
Figure 5:
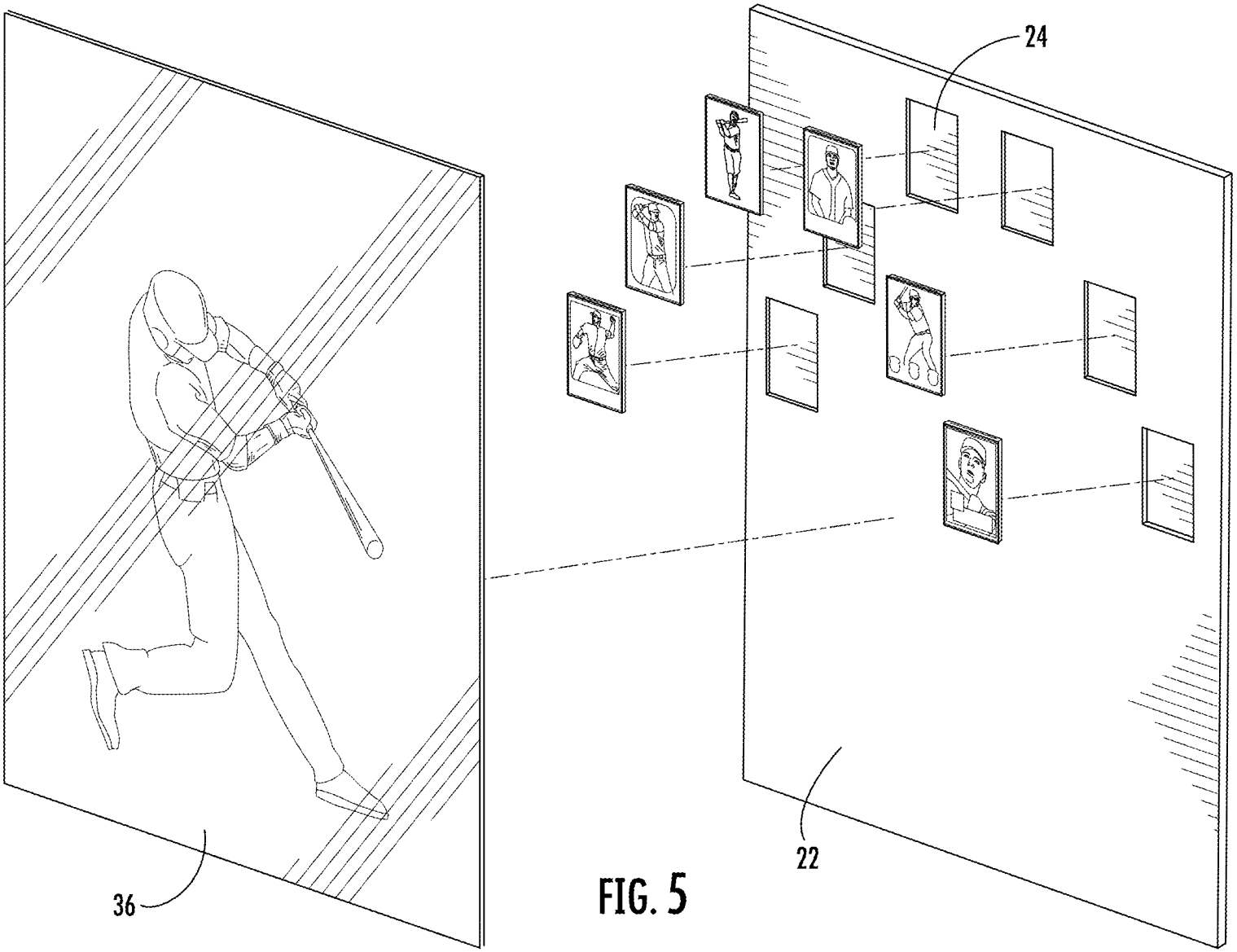
FIG. 5 is an exploded view of the display panel of FIG. 4 in accordance with an embodiment of the invention.

FIG. 4 shows an embodiment of the invention whereby front panel 36 is a sold panel without any cutouts. As shown in FIG. 5, backing panel 22 is provided with one more pockets. Cards that are set into the pockets are visible through transparent or translucent panel 36. It will be understood that areas of panel 36 that are parallel to pockets (e.g. 24) have no printed graphics thereby allowing visibility to underlying cards.

Figure 6:
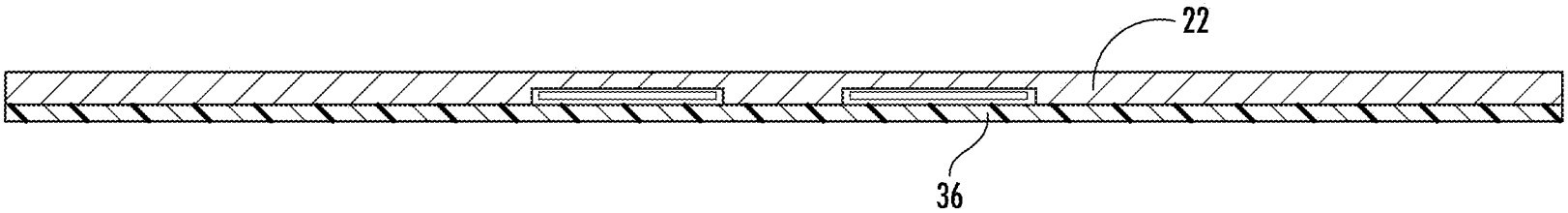
FIG. 6 is a top cross-sectional view of the display panel of FIGS. 4 and 5 in accordance with an embodiment of the invention.
Figure 7:
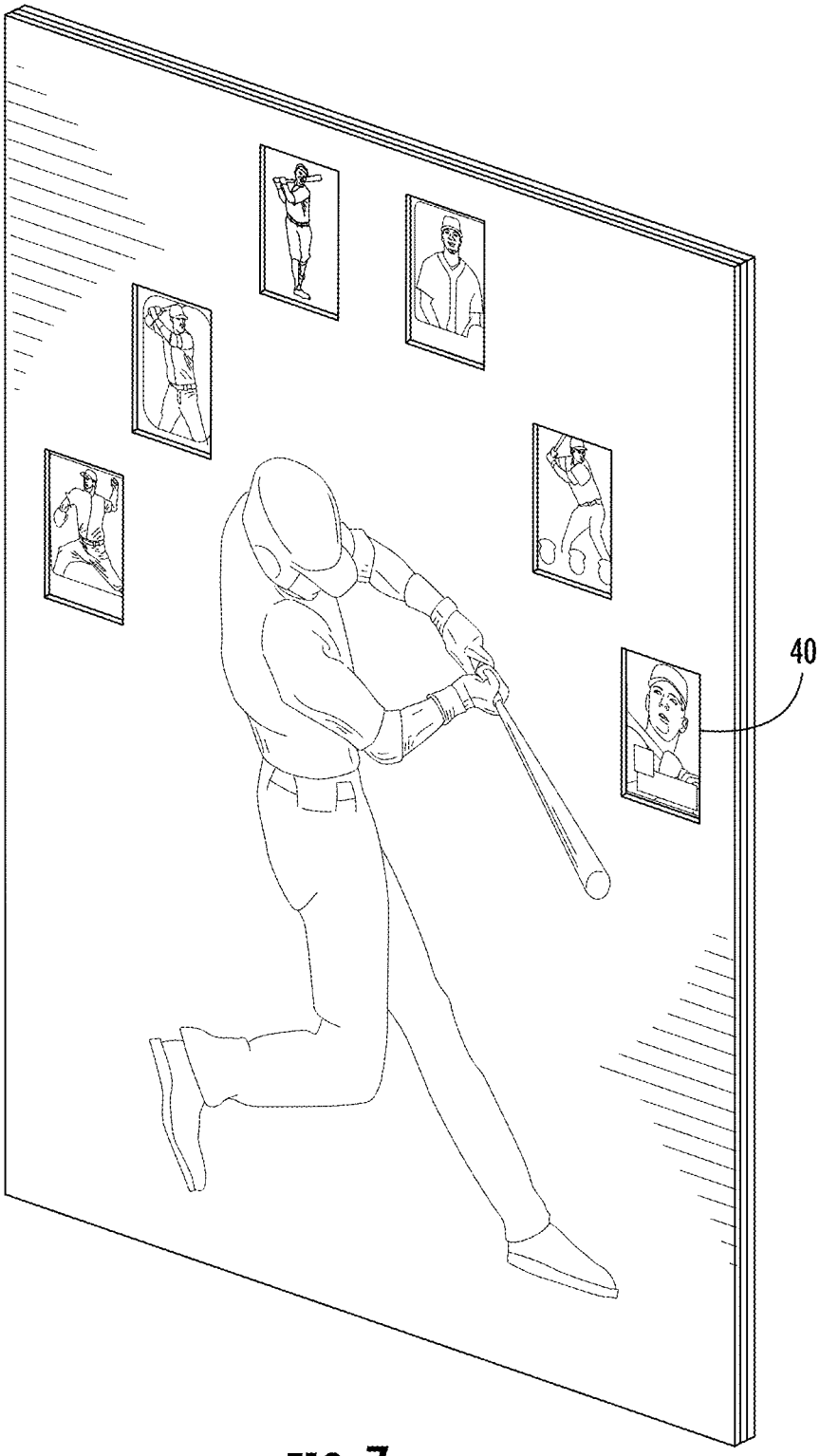
FIG. 7 is a perspective front view of a display panel front and back openings in accordance with an embodiment of the invention.

As shown in FIG. 6, cards are retained in pockets and are sandwiched between the pocket floor and the underside surface of panel 36 and between vertical and horizontal retaining surfaces 26, 28.

Figure 8:
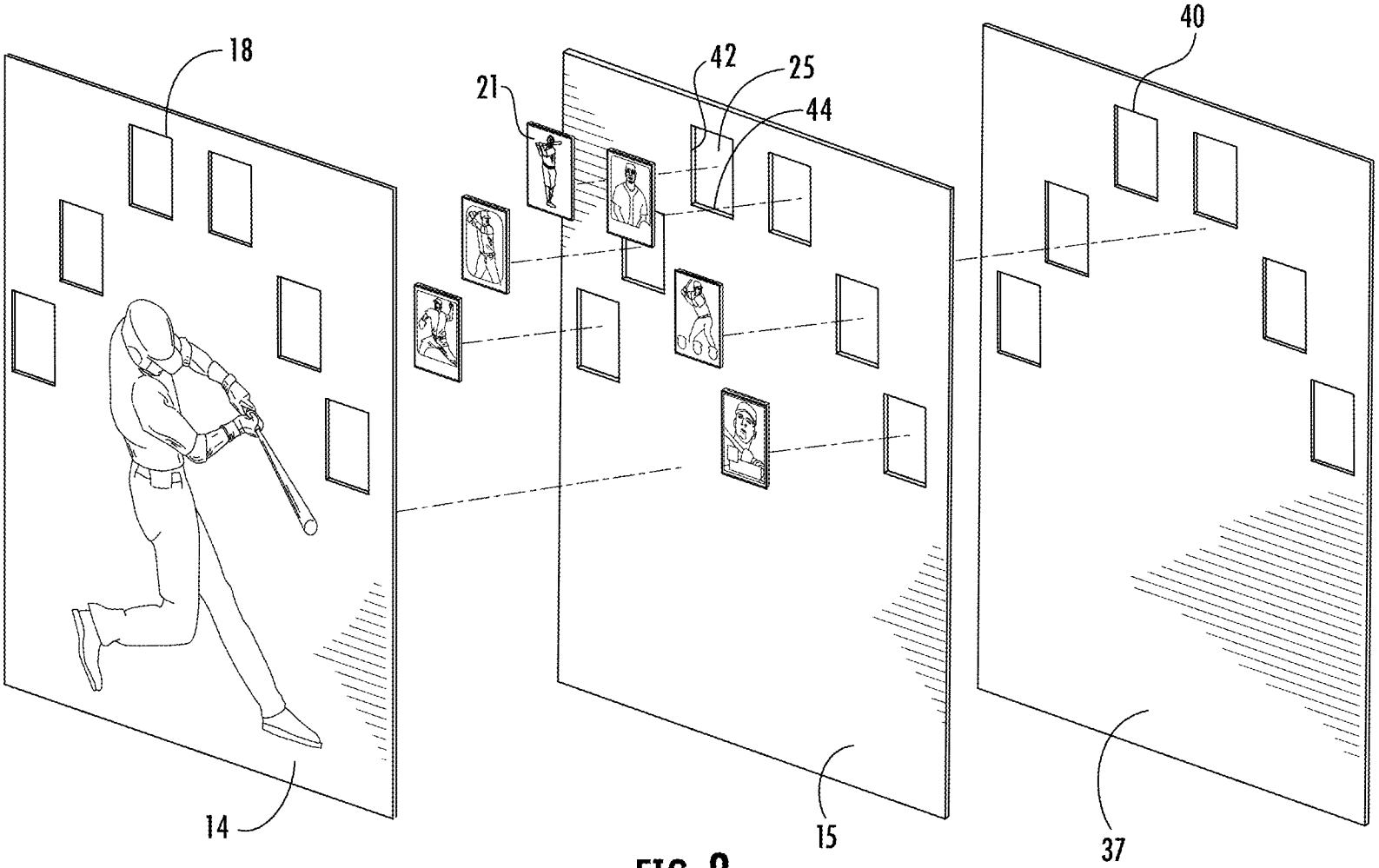
FIG. 8 is an exploded view of the display panel of FIG. 7 in accordance with an embodiment of the invention.

In yet another embodiment of the invention, and as shown in FIG. 8, a display panel is provided with front-facing cutouts and rear-facing cutouts thereby allowing viewers to access and physically touch the front and rear surfaces of cards stored in the display panel. In this embodiment, a display panel is formed of a front panel 14, a backing panel 15, and a rear panel 37. Front panel 14 is provided with cutouts (e.g. 18). Backing panel 15 is provided with card slots that are substantially sized and shaped to receive a card (e.g. 21). In this regard, card slot (e.g. 25) is formed of parallel vertical retaining surfaces (e.g. 42), and parallel horizonal retaining surfaces (e.g. 44), but there is no floor. Rear panel 37 is provided with cutouts (e.g. 40) that substantially mirror the cutouts on front panel 14.

Figure 9:
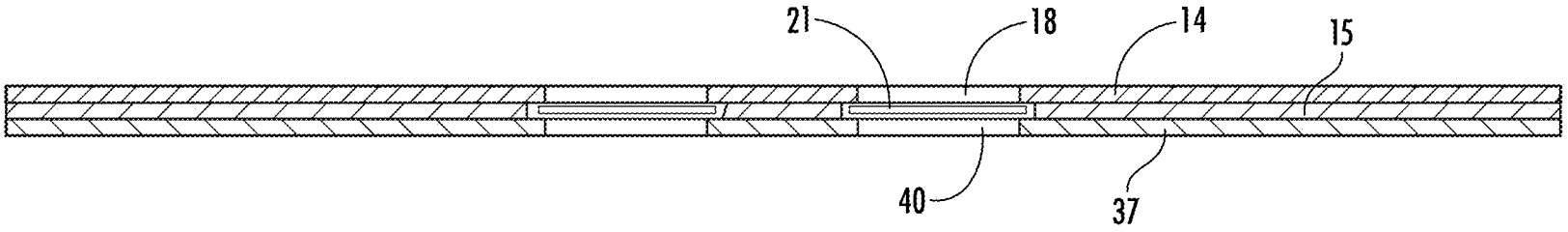
FIG. 9 is a top cross-sectional view of the display panel of FIGS. 7 and 8 in accordance with an embodiment of the invention.

FIG. 8 shows front panel 14 aligned with backing panel 15, which in turn is aligned with rear panel 37. In embodiments of the invention, the cutouts on front panel 14 and rear panel 37 are incrementally smaller than the dimensions of card slot 25. As such, and as shown in FIG. 9, a card is maintained in the card slot and is sandwiched by outer perimeters of respective cutouts on the front panel and the rear panel.

It will be understood that any of various display panel configurations are possible in embodiments of the invention. For example, with reference to FIG. 8, front panel 14 may be replaced with solid panel 36—thereby allowing only rear surfaces cards to be physically accessible.

It will be understood that front panel and backer panel (and rear panel in embodiments of the invention) are aligned and may be tightly secured together via any of various screw or similar fastening mechanism, stand offs, for example on each corner.

In embodiments of the invention, panel (e.g. 14) is formed of a transparent or translucent plastic material, such as for example, plexiglass, acrylic, or polycarbonate.

In embodiments of the invention, featured image 16 is reverse printed on an underside of panel 14 (or similar panel disclosed herein) such that it appears properly oriented when viewed from the front of the panel 14. In an embodiment area, a background area surrounding or adjacent to featured image 16 contains a pattern of small repeating design elements. In embodiments of the invention, the front of the panel (e.g. 14) is provided with a series of lenses that are positioned overlying the series of repeating design elements are viewable from the front of the panel 14. In this regard, when viewed through the lenses, the underlying series of repeating design elements are enlarged and appear as if projected onto a different image plane than the image plane belonging to the featured image 16. U.S. Pat. No. 12,020,596 describes the multidemsional printed panel and is fully incorporated by reference herein.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, manufacture and methods which, although not explicitly shown or described herein, embody the principles of the disclosure and are thus within the spirit and scope of the disclosure.

What is claimed is:

1. A card display device, comprising:

a panel having an upper surface and an underside surface;

an image reverse printed on the underside surface of the panel;

one or more cutouts on the panel;

a backing panel having one or more recessed areas substantially sized and shaped to receive a baseball card, the recessed areas comprising substantially parallel vertical retaining surfaces and substantially parallel horizontal retaining surfaces, and a floor surface, each recessed area being closed at a rear thereof by the floor surface, whereby each of the recessed areas are configured to receive a card such that a rear surface of a card rests against and is supported by the floor of the recessed area and the vertical retaining surfaces contact respective side surfaces of a card and the horizontal retaining surfaces contact the top and bottom surfaces of a card;

whereby the one or more cutouts have a perimeter that is incrementally smaller than a perimeter of the recessed areas such that a peripheral overhang of the panel surrounding each cutout overlies and contacts a front peripheral edge portion of the card and retains the card against the floor surface within the recessed area, while a remaining front surface of the card is exposed and directly accessible through the cutout.

2. The card display device of claim 1, wherein the panel is transparent.

3. The card display device of claim 1, wherein the backing panel comprises a foam material.

* * * * *